US006720994B1

(12) United States Patent
Grottodden et al.

(10) Patent No.: US 6,720,994 B1
(45) Date of Patent: Apr. 13, 2004

(54) SYSTEM AND METHOD FOR ELECTRONIC STABILIZATION FOR SECOND GENERATION FORWARD LOOKING INFRARED SYSTEMS

(75) Inventors: Nicole C. Grottodden, Torrance, CA (US); George M. Buritica, Cerritos, CA (US); Sam S. Nishikubo, Gardena, CA (US)

(73) Assignee: Raytheon Company, Waltham, MA (US)

( * ) Notice: Subject to any disclaimer, the term of this patent is extended or adjusted under 35 U.S.C. 154(b) by 0 days.

(21) Appl. No.: 09/428,414

(22) Filed: Oct. 28, 1999

(51) Int. Cl.[7] ..... H04N 5/228
(52) U.S. Cl. ..... 348/208.6; 348/208.2
(58) Field of Search ..... 348/208.99, 208.1, 348/208.4, 172, 208.6, 208.2

(56) References Cited

U.S. PATENT DOCUMENTS

| | | | | |
|---|---|---|---|---|
| 4,244,029 A | | 1/1981 | Lambert et al. | |
| 4,315,610 A | | 2/1982 | Malueg | |
| 4,637,571 A | | 1/1987 | Holder et al. | |
| 5,309,250 A | * | 5/1994 | Giacometti | 358/406 |
| 5,317,395 A | * | 5/1994 | Carr et al. | 348/164 |
| 5,702,068 A | * | 12/1997 | Stoll et al. | 244/3.16 |

FOREIGN PATENT DOCUMENTS

| | | |
|---|---|---|
| DE | 29 32 468 C | 6/1996 |
| FR | 2 678 461 | 12/1992 |

* cited by examiner

*Primary Examiner*—Andrew Christensen
*Assistant Examiner*—Tia M. Harris
(74) *Attorney, Agent, or Firm*—John E. Gunther; Colin Raufer; Glenn H. Lenzen, Jr.

(57) ABSTRACT

An image stabilization system and method. The inventive system (100) includes an image sampling circuit (230) mounted on a platform (400) for sampling an image in response to timing control signals and outputting a plurality of imaging signals in response thereto. An azimuth resolver (310) detects vibration of the platform and providing a signal in response thereto. A microprocessor (540) adjusts the timing control signals to cause the image sampling circuit (230) to sample the image and thereby compensate for an effect of vibration on the image. In the illustrative embodiment, the microprocessor (540) includes software for compensating for vibration that causes image offset, compressed images, expanded images, and compression and expansion within a single field. The invention provides image stabilization in a purely electronic manner without the need for any moving parts that would typically require control hardware and a significant amount of space. In addition, since LOS motion compensation takes place as the image is being sampled, this method eliminates the need for the large amounts of memory required to store a field of video as well as LOS information for post processing.

14 Claims, 6 Drawing Sheets

FIG. 1
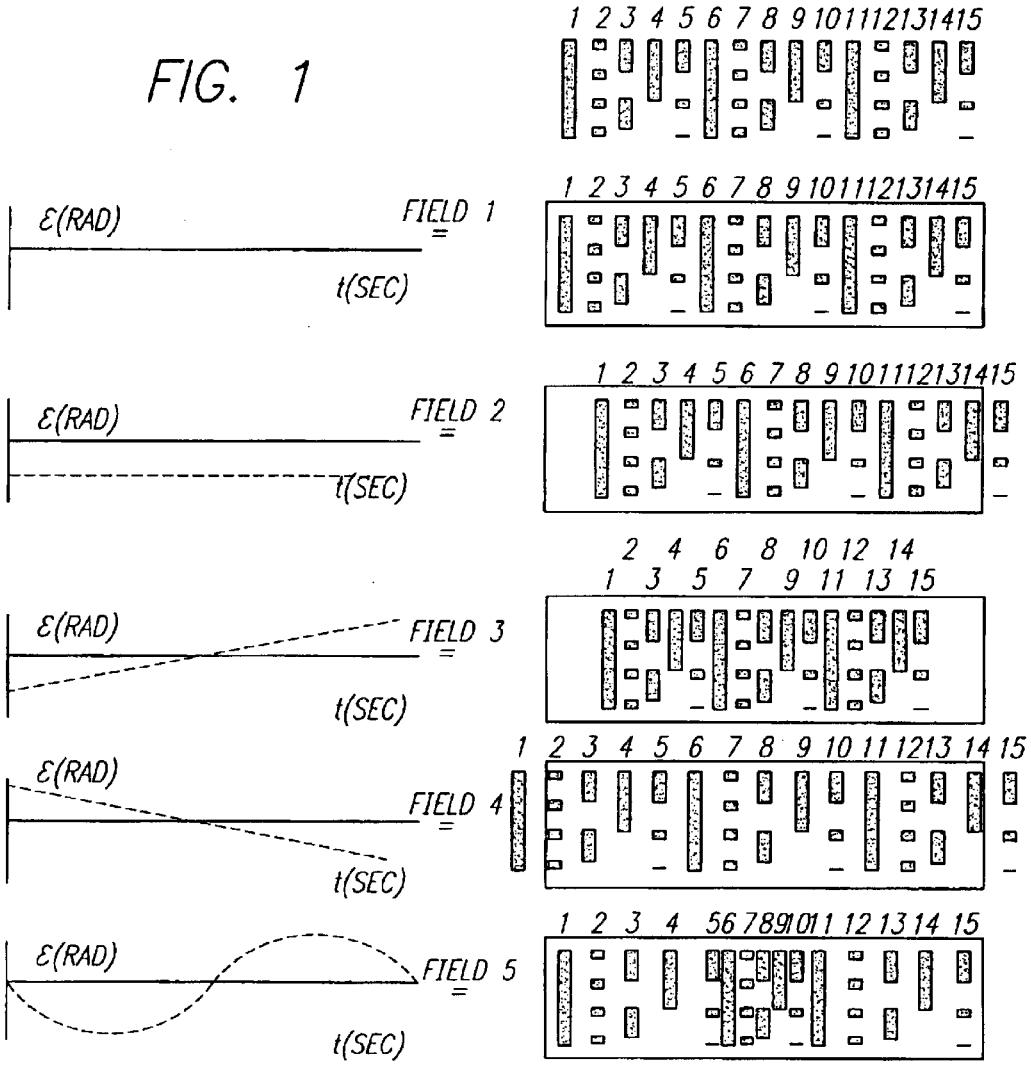
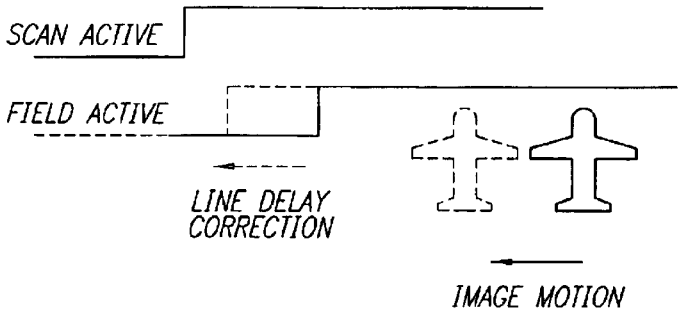
FIG. 2

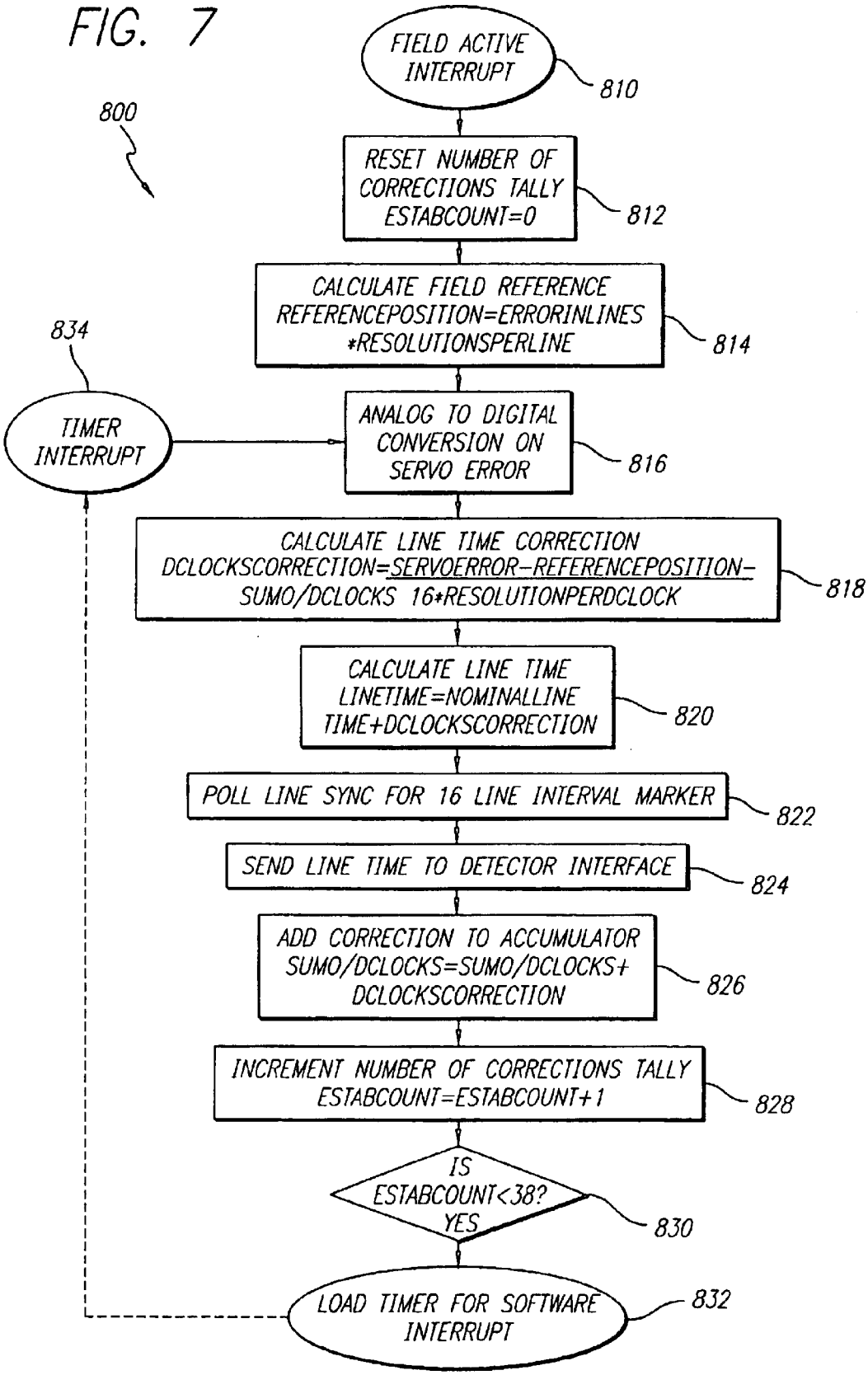
FIG. 7
800
FIELD ACTIVE INTERRUPT
810
RESET NUMBER OF CORRECTIONS TALLY ESTABCOUNT=0
812
CALCULATE FIELD REFERENCE REFERENCEPOSITION=ERRORINLINES *RESOLUTIONSPERLINE
814
834
TIMER INTERRUPT
ANALOG TO DIGITAL CONVERSION ON SERVO ERROR
816
CALCULATE LINE TIME CORRECTION DCLOCKSCORRECTION=SERVOERROR-REFERENCEPOSITION-SUMO/DCLOCKS 16*RESOLUTIONPERDCLOCK
818
CALCULATE LINE TIME LINETIME=NOMINALLINE TIME+DCLOCKSCORRECTION
820
POLL LINE SYNC FOR 16 LINE INTERVAL MARKER
822
SEND LINE TIME TO DETECTOR INTERFACE
824
ADD CORRECTION TO ACCUMULATOR SUMO/DCLOCKS=SUMO/DCLOCKS+ DCLOCKSCORRECTION
826
INCREMENT NUMBER OF CORRECTIONS TALLY ESTABCOUNT=ESTABCOUNT+1
828
IS ESTABCOUNT<38? YES
830
LOAD TIMER FOR SOFTWARE INTERRUPT
832

SYSTEM AND METHOD FOR ELECTRONIC STABILIZATION FOR SECOND GENERATION FORWARD LOOKING INFRARED SYSTEMS

BACKGROUND OF THE INVENTION

1. Field of the Invention

The present invention relates to imaging systems. More specifically, the present invention relates to infrared imaging systems and systems and methods for stabilizing same with respect to vibration.

2. Description of the Related Art

Imaging systems are widely used for numerous applications from navigation and guidance to astronomy. Infrared imaging systems allow for objects to be detected in low light level conditions that would not otherwise be detectable by the human eye. For this reason, numerous military systems have been supplemented in forward-looking infrared (FLIR) imaging systems.

Both FLIR and visible imaging systems suffer from image jitter due to vibration. Previously, imaging systems (particularly FLIR) used mechanical means to maintain the line-of-sight (LOS) stable. A common technique consisted of an inner gimbal, which, in essence, isolated the LOS from platform vibration that normally affected the outer gimbal. In general, airborne gimbaled systems are subjected to angular vibration inputs that result in residual servo errors. This servo error represents the deviation of the gimbal position from the pointing position. If left uncorrected, this error results in high frequency motion of the line-of-sight and degradation of the image. Hence, this method is not only limited as a solution, but it is costly and adds weight and size to the sensor, making this approach incompatible with many airborne applications.

Another technique utilizes a motion-compensating mirror built into the telescope to dynamically adjust the LOS. However, as with the previous method, this technique also increases sensor cost, weight and size. In addition, this system is difficult to implement as the mirror is fragile and requires a sophisticated control system. Further, the system performs poorly in that it creates an unsatisfactory rolling appearance to the operator.

A third method, purely electronic, uses memory to store the complete field of video and the corresponding vibration profile, which contains the LOS motion information. During read out to a monitor, the output video is stretched and compressed based on the recorded profile resulting in a stable LOS.

In addition to the memory necessary to store all the information required for post processing, this method has the disadvantage that any intermediate processing (e.g. target tracking) is performed on the image prior to stabilization. This results in performance degradation. In addition, the imagery is not available for tracking.

Hence, a need exists in the art for small, lightweight, effective yet inexpensive system or technique for compensating for jitter in imaging systems mounted on platforms that are subject to vibration and mechanical motion.

SUMMARY OF THE INVENTION

The need in the art is addressed by the image stabilization system and method of the present invention. The inventive system includes an image sampling circuit mounted on a platform for sampling an image in response to timing control signals and outputting a plurality of imaging signals in response thereto. An azimuth resolver detects vibration of the platform and providing a signal in response thereto. A microprocessor adjusts the timing control signals to cause the image sampling circuit to sample the image and thereby compensate for an effect of vibration on the imaging signals.

In the illustrative embodiment, the microprocessor includes software for compensating for vibration that causes image offset, compressed images, expanded images, and compression and expansion within a single field.

The present invention provides image stabilization in a purely electronic manner without the need for any moving parts that would typically require control hardware and a significant amount of space. In addition, since LOS motion compensation takes place as the image is being sampled, this method eliminates the need for the large amounts of memory required to store a field of video as well as LOS information for post processing.

The present invention may also offer improvements in system performance by providing the stabilized image to the autotracker thus minimizing track jitter and video latency.

BRIEF DESCRIPTION OF THE DRAWINGS

FIG. 1 is a series of diagrams that depict the effects of various servo errors on a scene detected by an illustrative forward-looking infrared imaging system.

FIG. 2 shows the adjustment of the time between scan active and field active required to correct for image motion due to platform vibration.

FIG. 7 is a flow diagram that illustrates the method for correcting for line timing in response to a field active interrupt in accordance with the present teachings.

DESCRIPTION OF THE INVENTION

Figure 3:
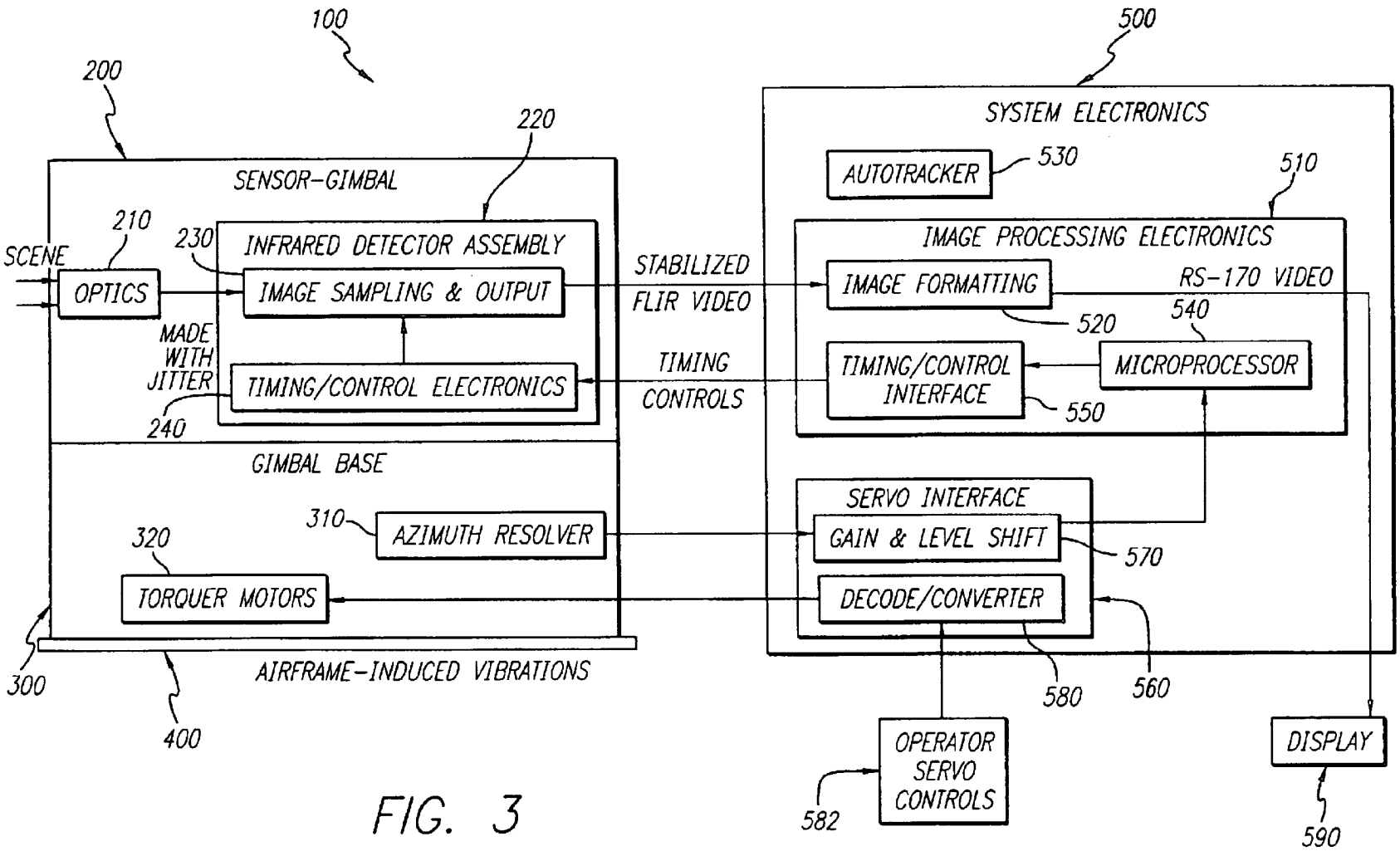
FIG. 3 is a system level block diagram of a gimbaled sensor mounted on an airframe with associated system electronics in accordance with the teachings of the present invention.

Illustrative embodiments and exemplary applications will now be described with reference to the accompanying drawings to disclose the advantageous teachings of the present invention.

While the present invention is described herein with reference to illustrative embodiments for particular applications, it should be understood that the invention is not limited thereto. Those having ordinary skill in the art and access to the teachings provided herein will recognize additional modifications, applications, and embodiments within the scope thereof and additional fields in which the present invention would be of significant utility.

FIG. 1 is a series of diagrams that depict the effects of various servo errors on a scene detected by an illustrative forward-looking infrared imaging system. In general, airborne gimbaled systems are subjected to angular vibration inputs, which result in residual servo errors. This servo error represents the deviation of the gimbal position from the pointing position. If left uncorrected, this error results in high frequency motion of the line-of-sight and degradation of the image. This is illustrated in FIG. 1, where the right hand corner shows a simulated scene consisting of 15 vertical lines. Five displayed fields of this scene are shown.

Field 1 is the baseline. Here no residual servo error is present. The line of sight is stable and the resulting displayed image is shown in the rectangle.

On Field 2, the detector begins sampling the scene when the LOS is to the left of line 1 and therefore line 1 is pushed toward the right of the display. As the error is constant throughout the field, the image is simply pushed to the right in the display.

On Field 3, as per Field 2, the detector begins sampling the scene when the LOS is to the left of line 1, pushing line 1 toward the right of the display. By the time the detector samples line 8, the error is at zero (note that line 8 lines up with Field 1). As the error increases, the line of sight moves to the right and line 15 is sampled earlier. Note that in this case the image is compressed with respect to field one because the residual error moves the LOS in the direction of the sampling.

The opposite is true on Field 4 and therefore the image is expanded.

Field 5 shows the effect of a sinusoidal error where portions of the image are expanded and other portions are compressed.

In accordance with the teachings of the present invention, the azimuth residual servo error is compensated with the fine resolution of electronic image stabilization by dynamically adjusting when the detectors sample the scene. If on Field 1 the start of sampling of Field 2 is delayed, then line 1 moves to the left on the display. If on Field 3 the sample is delayed and the time between samples is adjusted, then the image of Field 3 can be made to appear like the image of Field 1. Thus, two steps are necessary to electronically stabilize and image:

1) The starting position of each field must be corrected and
2) The detector sample frequency must be adjusted to correct for inner field errors.

I. Correcting the Starting Position of the Field

In accordance with the present teachings, prior to the start of the field, the servo error is measured and converted to an image offset in radians. The image offset is rounded to a number of line samples. Since this is occurring at the detector level, prior to scan conversion, a line of video (in the illustrative embodiment FLIR video), contains the information which corresponds to a column of displayed video. Those skilled in the art will appreciate that the present invention is not limited to infrared imaging systems. The teachings of the present invention may be used for visible and other imaging systems without departing from the scope of the present teachings.

The first line sample is shifted by the number of samples needed to correct for the initial error. This delay correction is made with respect to the active scan period and may be adjusted from the nominal position based on the direction of the servo error.

Since the line delay correction is made in increments of one line (one column of displayed video), the resolution of the starting position is limited to a full sample. This resulting uncorrected portion of the error is carried through to the inner field correction.

FIG. 2 shows the adjustment of the time between scan active and field active required to correct for image motion due to platform vibration. A servo error which causes the image to be shifted closer to the start of the field requires decreasing the line delay as shown. This essentially starts the field earlier, which will shift the displayed image back to its nominal position.

II. Correcting Inner-field Video Timing

In accordance with the present teachings, servo errors within the field are corrected by adjusting the line timing. Line timing is represented by the number of detector clocks per FLIR video line. Adjusting the line time varies the dead time between FLIR video lines. By adjusting the line time, the image is contracted and expanded to correct for the servo error. Increasing the dead time increases the time between scene samples displayed on adjacent video lines. Consequently, increasing the line time has the effect of contracting the image. In the illustrative embodiment, the nominal line time is 64 detector clocks, line time corrections are made in increments of 1 detector clock, and the range of line times is 64±4.

The residual servo error is nulled after the line delay correction by adjusting the line time in the first 16 lines of video. Thereafter, the servo error is sampled at an appropriate rate (e.g., 3.3 Khz) and the line time is updated at a regular interval (e.g., every 16 lines) to correct for the existing servo error as it changes throughout the field. Inner field servo error corrections are referenced to the initial line delay correction.

III. Methodology

In accordance with the present teachings, the scan active to field active nominal line delay is adjusted by the number of lines of initial servo error. The nominal line delay is set to accommodate the initial servo error compensation calculation when the servo error is at maximum amplitude. The line delay may then be increased or decreased from nominal to correct the initial servo error. Therefore the line delay is equal to the nominal line delay when the servo error is zero. The initial servo error, $ServoError_0$, is measured prior to the start of the field, just after the scan active rising edge.

The following algorithms are used for the line delay correction:

$$LineDelay = NominalLineDelay + ErrorInLines \quad [1]$$

$$ErrorInLines = ServoError_0 / ResolutionPerLine \quad [2]$$

The line time for the first 16 lines is adjusted by the number of detector clocks (DClocks) needed to null the residual servo error after the line delay correction. The difference between the line delay correction and the initial servo error is converted to a number of detector clocks adjustment to the nominal line time. The adjusted line time is used over an interval of 16 lines. The resolution per detector clock depends on the current field of view.

The following algorithms are used for the line time correction during the first 16 lines:

$$LineTime_0 = NominalLineTime - DClocksCorrection_0 \quad [3]$$

$$ClocksCorrection_0 = \frac{(ErrorInLines * ResolutionPerLine - SevroError_0)}{16 * ResolutionPerDClock} \quad [4]$$

The resolution per line is determined by the number of lines sampled in the azimuth field of view. For the illustrative embodiment, assume that the system has 618 columns of FLIR video before scan conversion. The resolution per line is calculated for each field of view as follows:

$$ResolutionPerLine = \text{Azimuth Field of View (radians)}/618 \text{ lines} \quad [5]$$

$$ResolutionPerDClock = ResolutionPerLine/(64DClocks/Line) \quad [6]$$

Corrections within the field are made based on the input servo error, adjusted by the reference line delay correction. The resulting detector clocks correction for each 16-line interval is then adjusted by the sum of all line time corrections made thus far within the field.

The following algorithms are used to correct for inner field servo errors every 16 lines:

$$LineTime_n = NominalLineTime + DClocksCorrection_n \quad [7]$$

$$DClocksCorrection\ n = DClocksError_n - SumOfDClocks_n \quad [8]$$

$$DClocksError_n = ServoError_n/16 * ResolutionPerDClock \quad [9]$$

$$SumOfDClocks_n = \Sigma DClocksCorrection_n \quad [10]$$

(summed from 0 to n−1 where n is the current interval)

$$ServoError_n = ServoErrorInput - ReferencePosition \quad [11]$$

$$ReferencePosition = ErrorInLines * ResolutionPerLine \quad [12]$$

IV. Implementation

FIG. 3 is a system level block diagram of a gimbaled sensor mounted on an airframe with associated system electronics in accordance with the teachings of the present invention. The system 100 includes a gimbaled sensor 200 mounted on a gimbaled base 300 which is attached to an airframe 400. The sensor 200 includes optics 210 and, in the illustrative embodiment, an infrared detective assembly 220. The infrared detective assembly 220 includes an image sampling circuit 230 and a timing and control circuit 240. Input imagery from a scene is received by the optics 210 and provided to the infrared detective assembly 220 as an image with jitter. The image is sampled and output to system electronics 500 as stabilized FLIR video in response to timing control signals received therefrom.

The system electronics unit 500 includes image processing electronics 510, an autotracker 530, and a servo interface 560. The autotracker is an elective component of the system that may have improved performance by providing it with stabilized imagery. Vibration in the airframe 400 is sensed by the gimbal base 300 and is communicated by the azimuth resolver 310 to the system electronics 500. A gain and level shift circuit 570 in the servo interface 560 adjusts the gain and level of the signals received representing the sense vibration and provides the adjusted signals to a microprocessor 540 in the image processing electronics 510. The microprocessor 540 calculates, in real time, the necessary line and field delays required to cause the image to be sampled in such a way as to compensate for the vibration in accordance with the teachings provided herein. The microprocessor 540 communicates the corrections to the timing control and electronics circuit 240 of the infrared detective assembly 220 via a timing control interface circuit 550. The microprocessor 540 essentially changes the timing of the sampling, in real time, as the image is being sampled.

Stabilized FLIR video is provided by the image sampling circuit 230 of the infrared detective assembly 220 to an image formatting circuit 520 in the image processing circuit 510. The image formatting circuit 520 outputs formatted baseband (e.g., RS-170) video to a display 590. Operator servo controls are received through an interface 582, decoded by a decoder/converter 580 in the servo interface 560 of the system electronics 500 and communicated to torquer motors 320 in the gimbal base 300.

Figure 4:
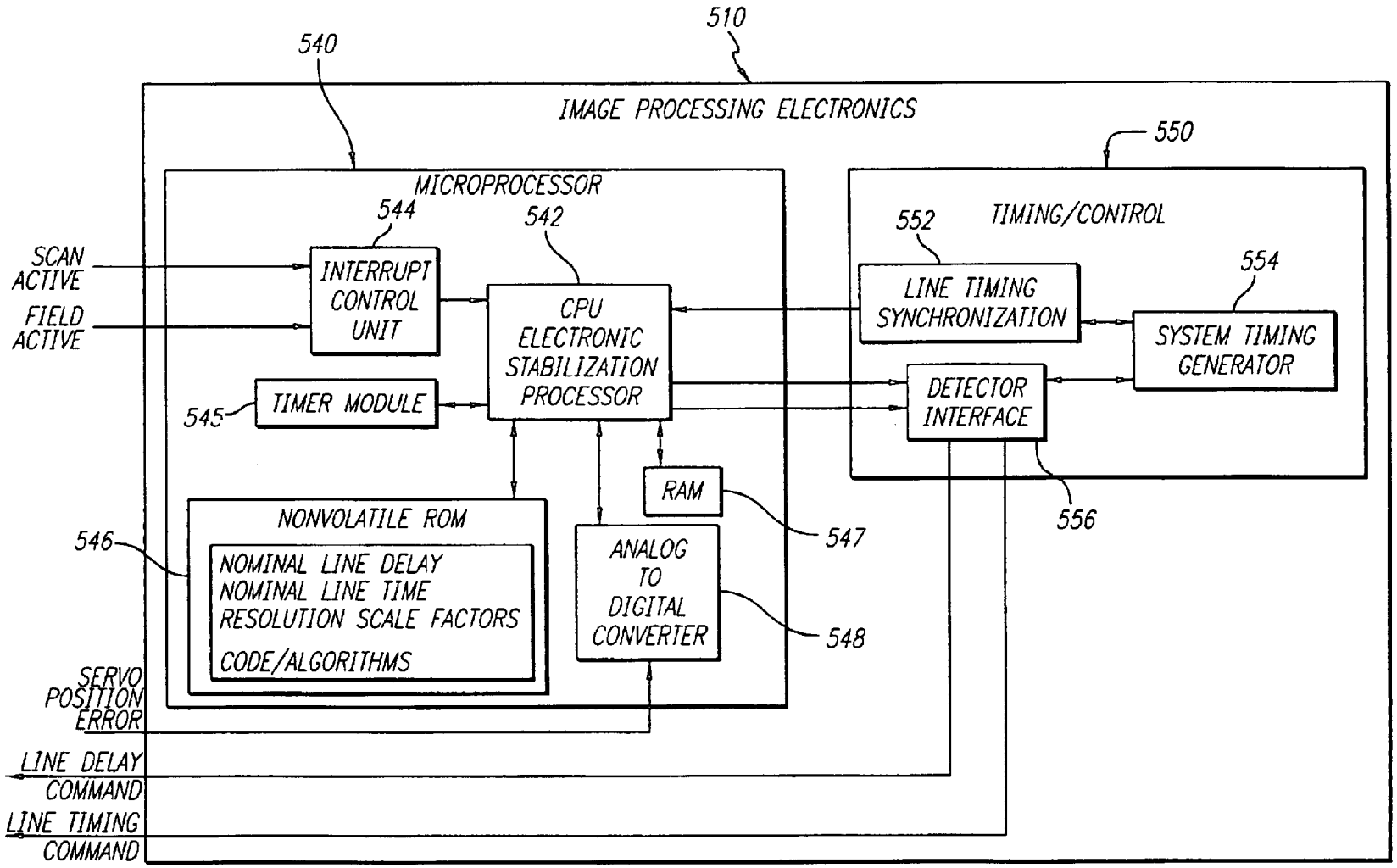
FIG. 4 is a block diagram of the image processing system of the system depicted in FIG. 3 in accordance with the present teachings.

FIG. 4 is a block diagram of the image processing system of the system depicted in FIG. 3 in accordance with the present teachings. "Scan active" and "field active" timing signals are received from the timing and control circuit 240. The used signals generate interrupts within the central processing unit 542 of the microprocessor 540 causing it to calculate line and field timing corrections required to compensate for vibration in the manner described more fully below.

Figure 5:
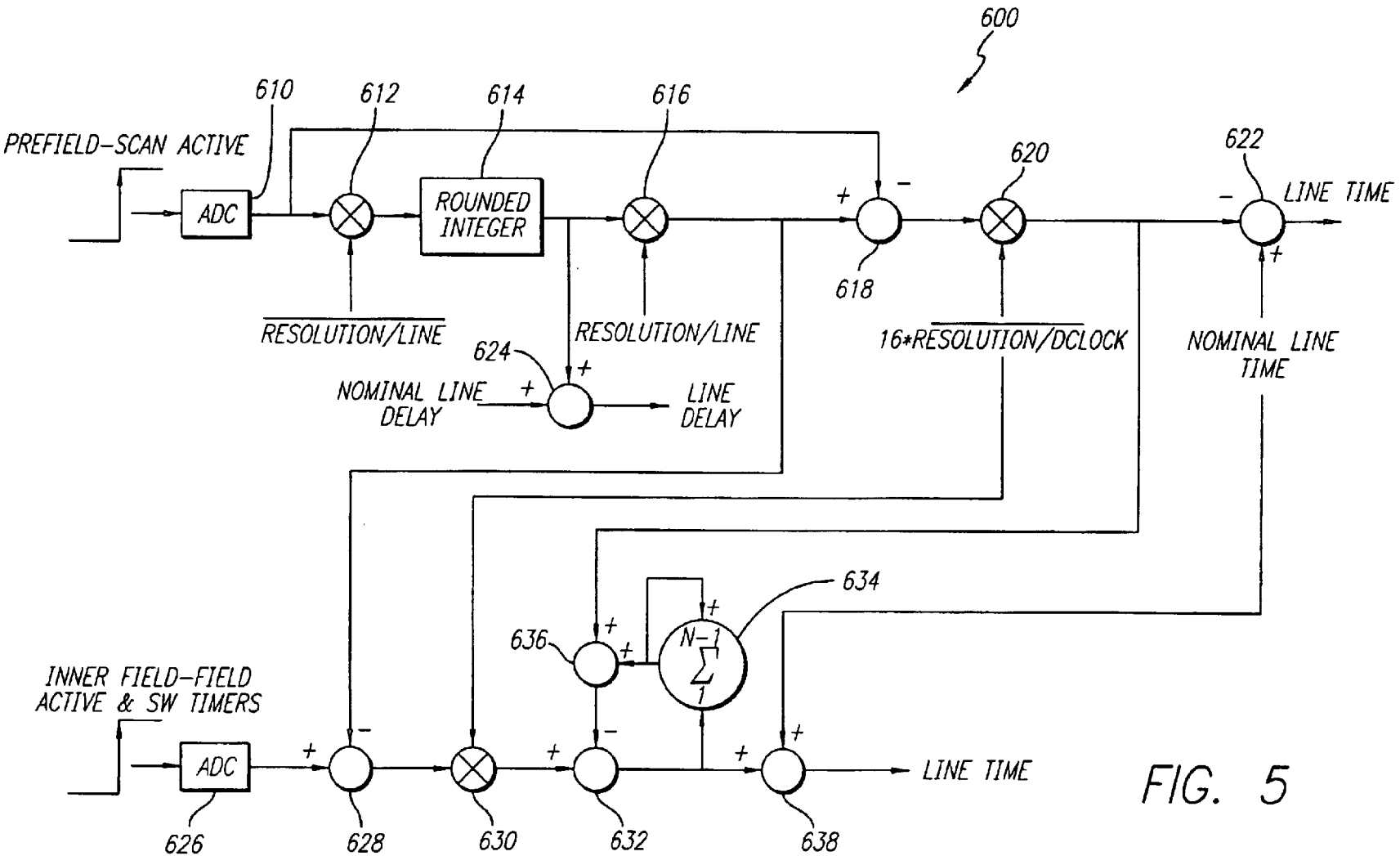
FIG. 5 is a diagram that depicts the operation of the electronic stabilization processing system of the present invention.

FIG. 5 is a diagram that depicts the operation of the central processing unit 542 of the microprocessor 540 of the present invention. As depicted in FIG. 5, on receipt of a scan active interrupt, the servo error is converted from an analog signal to a digital signal by an analog to digital converter 610. The analog to digital conversion shown at 610 is implemented by the analog to digital converter 548 of FIG. 4. Again, this conversion step may be provided by the ADC 548 of FIG. 4.

At multiplier 612, the digitized servo error is divided by the resolution per line and at 614 the resulting value is rounded. The output of the multiplier 612 provides an indication of the number of lines that the servo error is equivalent to. The rounded value representing the number of lines of error is summed with a nominal line delay at summer 624 and output as the 'line delay'. The number of lines of error may be positive or negative, depending on the direction of the servo vibration. The nominal line delay is set to accommodate the maximum initial error in either direction. The resulting value for the line delay is output to the detector interface 556 of the timing control circuit 550 and subsequently communicated to the image sampling circuit 230 via the timing control electronics circuit 540 and the detector adjusts the starting position of the field accordingly. (See FIG. 4.)

Returning to FIG. 5, the next step is to ascertain the exact amount of servo error based on the amount of residual servo error in view of the rounding operation. Accordingly, at multiplier 616, the rounded value is multiplied by the resolution per line to ascertain the amount of initial correction. At subtractor 618, this value is subtracted from the fed-forward digitized value to provide the residual error signal.

At multiplier 620, the residual error is divided by 16 times the resolution of a clock. This is due to the fact that in the illustrative embodiment, each line timing correction is implemented for an entire 16 line interval. As, the correction output at subtractor 618 is the correction over 16 lines, the correction is divided by 16 times the clock frequency to ascertain the correction over one line in detector clock cycles. At subtractor 622 the correction over one line in detector clock cycles is added to the nominal line time to provide the prefield 'line time' for the first 16 lines. When a field starts, the detector uses this value to adjust the line time.

Line time corrections within a field begin with a 'field active' interrupt and a digitization of the instantaneous servo error with an analog-to-digital conversion step 626. This process repeats every 16 lines. That is, given 618 lines in a field in the illustrative embodiment, the process in the 'scan active' leg is repeated once each field and the process in the 'field active' leg is repeated 39 times for each field. Those skilled in the art will appreciate that in this context, a 'field' represents a 'scan' of the detector.

At subtractor 628, the field offset reference calculated by multiplier 616 is subtracted from the instantaneous servo error. This adjusts for the initial line delay correction, leaving the remaining residual servo error. At multiplier 630, this value is divided by 16 times the resolution per detector clock to yield the correction per line in terms of detector clocks.

Figure 6:
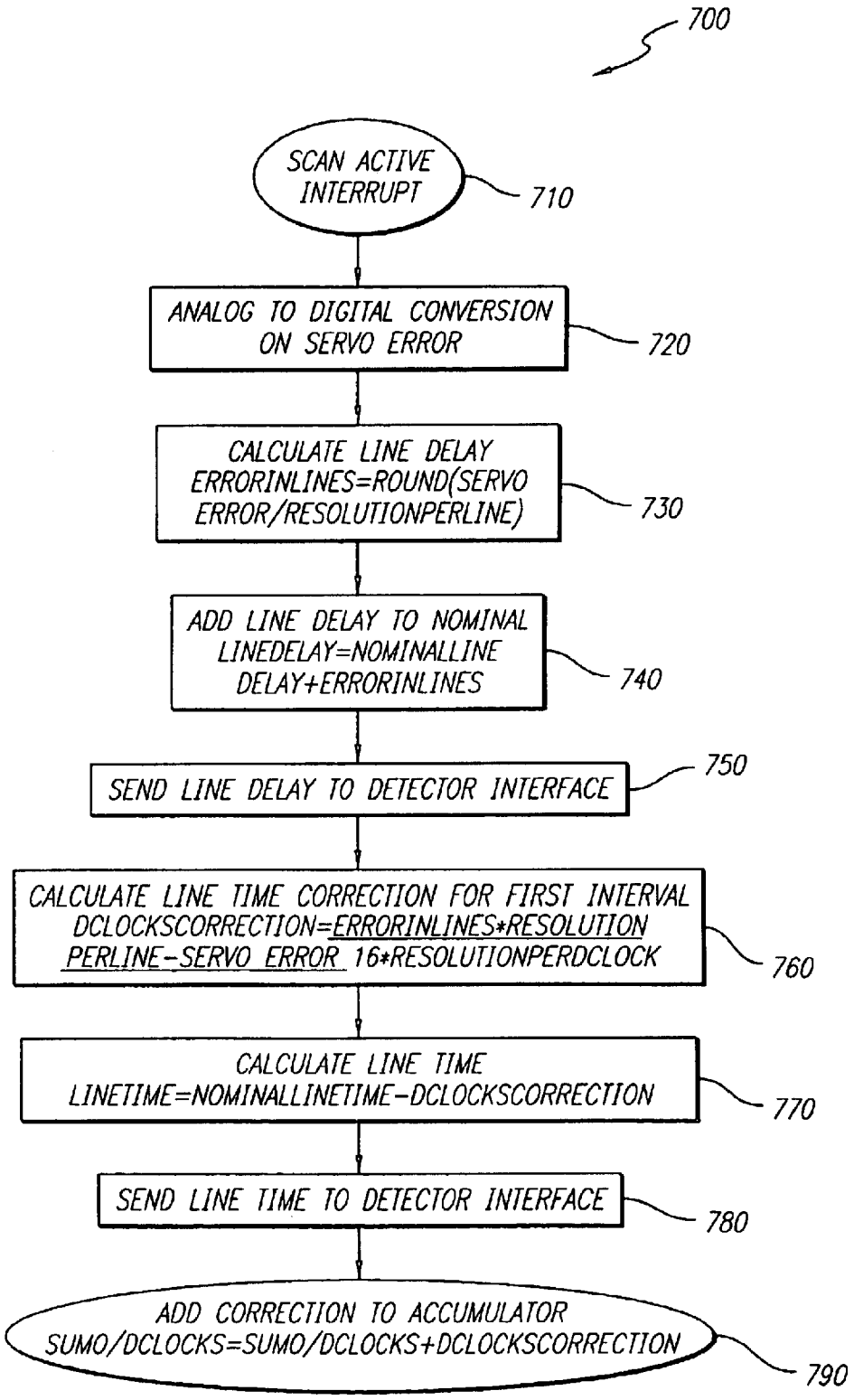
FIG. 6 is a flow diagram that illustrates the method for correcting for line delay and line timing in response to a scan active interrupt in accordance with the present teachings.

Next, at subtractor 632, the initial timing correction provided by multiplier 620 is subtracted out because this correction was made at the beginning of the field. In addition, an accumulation of all of the timing corrections made within a field are subtracted. This. provides an indication of the number of detector clocks needed to make the field time correction. By subtracting the number of detector clocks already calculated for the delay and adding the nominal line time (adder 638) the line time correction for the next 16 lines is calculated. Again, this value is output to the image sampling circuit 230 via the detector interface 556, timing control interface 550 and timing control electronics 240. This operation is depicted in FIGS. 6 and 7 below. (Note that the nominal line delay, nominal line time, and resolution scale factors are provided by the microprocessor memory 546.)

FIG. 6 is a flow diagram that illustrates the method for correcting for line delay and line timing in response to a scan active interrupt in accordance with the present teachings.

FIG. 7 is a flow diagram that illustrates the method for correcting for line timing in response to a field active interrupt in accordance with the present teachings. Note that in FIG. 7, at step 822, the line sync is polled for a 16 line interval marker. This signal is provided by the line timing synchronization circuit 552 of the timing control circuit 550 in FIG. 4.

In FIG. 4, the detector interface provides formatting and other conventional functions. The system timing generator provides line sync signals. The timing control circuit is often implemented a single field programmable gate array (FPGA).

Thus, the present invention has been described herein with reference to a particular embodiment for a particular application. Those having ordinary skill in the art and access to the present teachings will recognize additional modifications, applications and embodiments within the scope thereof. For example, as mentioned above, the present teachings are not limited to infrared imaging applications.

It is therefore intended by the appended claims to cover any and all such applications, modifications and embodiments within the scope of the present invention.

Accordingly,

What is claimed is:

1. An image stabilization system comprising:

first means mounted on a platform for sampling an image in response to timing control signals and outputting a plurality of imaging signals in response thereto;

second means for detecting vibration of said platform and providing a signal in response thereto; and third means responsive to said second means for adjusting said timing control signals to cause said first means to sample said image and thereby compensate for an effect of vibration on said imaging signals, said third means including means for compensating for vibration which causes compressed images.

2. The invention of claim 1 wherein said third means includes means for compensating for vibration which causes image offset.

3. The invention of claim 1 wherein said third means includes means for compensating for vibration which causes compression and expansion within a field of imagery.

4. The invention of claim 1 wherein said third means further includes means for calculating line delay for a field of image data.

5. The invention of claim 4 wherein said third means further includes means for calculating line time for a field of image data.

6. The invention of claim 5 wherein said third means further includes means for utilizing said line delay and line time to adjust the timing of said samples.

7. An image stabilization system comprising:

an image sampling circuit mounted on a platform for sampling an image in response to timing control signals and outputting a plurality of imaging signals in response thereto;

an azimuth resolver for detecting vibration of said platform and providing a signal in response thereto; and a microprocessor responsive to said resolver for adjusting said timing control signals to cause said image sampling circuit to sample said image and thereby compensate for an effect of vibration on said imaging signals, said microprocessor including software for compensating for vibration which causes compressed images.

8. The invention of claim 7 wherein said microprocessor includes software for compensating for vibration which causes image offset.

9. The invention of claim 7 wherein said microprocessor includes software for compensating for vibration which causes compression and expansion within a field of imagery.

10. The invention of claim 7 wherein said microprocessor further includes software for calculating line delay for a field of image data.

11. The invention of claim 10 wherein said microprocessor further includes software for calculating line time for a field of image data.

12. The invention of claim 11 wherein said microprocessor further includes software for utilizing said line delay and line time to adjust the timing of said samples.

13. An image stabilization system comprising:

first means mounted on a platform for sampling an image in response to timing control signals and outputting a plurality of imaging signals in response thereto;

second means for detecting vibration of said platform and providing a signal in response thereto; and third means responsive to said second means for adjusting said timing control signals to cause said first means to sample said image and thereby compensate for an effect of vibration on said imaging signals, said third means including means for compensating for vibration which causes compression and expansion within a field of imagery.

14. An image stabilization system comprising:

an image sampling circuit mounted on a platform for sampling an image in response to timing control signals and outputting a plurality of imaging signals in response thereto;

an azimuth resolver for detecting vibration of said platform and providing a signal in response thereto; and a microprocessor responsive to said resolver for adjusting said timing control signals to cause said image sampling circuit to sample said image and thereby compensate for an effect of vibration on said imaging signals, said microprocessor including software for compensating for vibration which causes compression and expansion within a field of imagery.

* * * * *